US006302657B1

(12) United States Patent
Ota et al.

(10) Patent No.: US 6,302,657 B1
(45) Date of Patent: Oct. 16, 2001

(54) STRUCTURE FOR CONTROLLING CAPACITY IN VARIABLE DISPLACEMENT COMPRESSOR

(75) Inventors: Masaki Ota; Ken Suitou; Ryo Matsubara; Taku Adaniya, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/560,259

(22) Filed: Apr. 26, 2000

(30) Foreign Application Priority Data

May 19, 1999 (JP) ..... 11-138673

(51) Int. Cl.[7] ..... F04B 1/26; F04B 1/02; F01B 3/00

(52) U.S. Cl. ..... 417/222.2; 417/222.1; 417/269; 92/71; 91/499

(58) Field of Search ..... 417/269, 222.1, 417/222.2; 92/71; 91/499

(56) References Cited

U.S. PATENT DOCUMENTS 3,062,020 * 11/1962 Heidorn ..... 62/196
4,586,874 * 5/1986 Hiraga et al. ..... 417/222
4,836,090 * 6/1989 Smith ..... 92/12.2
5,582,092 * 12/1996 Nomura et al. ..... 92/12.2
5,722,310 * 3/1998 Ota et al. ..... 92/12.2
5,762,476 * 6/1998 Ota et al. ..... 417/222.2
5,807,076 * 9/1998 Kawaguchi et al. ..... 417/228
5,826,488 * 10/1998 Arai et al. ..... 92/12.2
5,857,402 1/1999 Hoshida et al. ..... 92/12.2
5,984,643 11/1999 Ota et al. ..... 417/269

FOREIGN PATENT DOCUMENTS 198 08 256 A 9/1998 (DE) .
0 769 620 A 4/1997 (EP) .
7-158560 6/1995 (JP) .
10-246181 9/1998 (JP) .

* cited by examiner

*Primary Examiner*—Charles G. Freay
*Assistant Examiner*—Timothy P. Solak
(74) *Attorney, Agent, or Firm*—Woodcock Washburn Kurtz Mackiewicz & Norris LLP

(57) ABSTRACT

A wear-resistant piece 29 is attached to a swash place 20 supported for inclination according to the present invention. The maximum inclination angle of the swash plate 20 is defined by the contact of rotary support 19 rotatable together with a rotary shaft 18. The rotary shaft 18 rotates in the arrowed direction Q, and the position at which the wear-resistant piece 29 is attached is contained in a discharge stroke region De on the swash plate 20 wherein a piston 26 carries out the discharge operation.

6 Claims, 8 Drawing Sheets

STRUCTURE FOR CONTROLLING CAPACITY IN VARIABLE DISPLACEMENT COMPRESSOR

BACKGROUND OF THE INVENTION

1. Field of the Invention

The present invention relates to a structure for controlling the capacity of a variable displacement compressor comprising a swash plate, accommodated in a control pressure chamber, rotatable together with a rotary shaft and variable in inclination angle relative to the rotary shaft and a plurality of pistons, arranged around the rotary shaft and subject to a reciprocating motion corresponding to the inclination angle of the swash plate, wherein the inclination angle of the swash plate is controlled by regulating the pressure in the control pressure chamber.

2. Description of the Related Art

In a variable displacement compressor of the type disclosed in Japanese Unexamined Patent Publication (Kokai) No. 10-246181, as the pressure in a crank chamber (the control pressure chamber referred to in this text) becomes higher, the inclination angle of the swash plate becomes smaller to reduce the discharge capacity, while as the pressure in the crank chamber becomes lower, the inclination angle of the swash plate becomes larger to increase the discharge capacity. In a variable displacement compressor of this type which is capable of controlling the capacity in accordance with the pressure in the crank chamber, the maximum inclination angle of the swash plate is defined by interrupting the inclination of the swash plate by a rotary support which rotates together with the rotary shaft and supports the swash plate via a hinge mechanism.

The swash plate is made of aluminum for the purpose of weight reduction, which has a drawback in that direct contact of a rotary support, made of iron, with the swash plate made of aluminum causes wear of a contact portion of the swash plate. If the contact portion of the swash plate is worn, the maximum inclination angle of the swash plate may be changed. To solve such a problem, according to the compressor disclosed in Japanese Unexamined Patent Publication (Kokai) 10-246181, an iron weight is attached to the swash plate so that direct contact is made between the iron weight and the rotary support. Wear of the swash plate is avoided by this arrangement of direct contact between iron members whereby the maximum inclination angle of the swash plate is prevented from changing.

A pair of restriction bosses are formed integral with the rotary support to be in contact with the weight. The hinge mechanism consists of a pair of support arms formed on the rotary support side and a single guide pin secured on the swash plate side wherein opposite ends of the guide pin engage into guide holes of the respective support arms. Accordingly, when the swash plate is at the maximum inclination, this maximum inclination angle is maintained in a stable state by four contact portions; i.e., those between the pair of guide holes and the guide pin and between the pair of restriction bosses and the weight. The positions at which the pair of restriction bosses are brought into contact with the weight are symmetrical on the circumference of the swash plate about the top dead center as seen in the axial direction of the drive shaft. That is, one of the contact positions between the pair of restriction boss and the weight is contained in a discharge stroke zone on the swash plate about the rotary shaft as seen in the axial direction of the drive shaft, while the other of the contact positions between the pair of the restriction boss and the weight is contained in a suction stroke zone on the swash plate about the drive shaft as seen in the axial direction of the drive shaft. The discharge stroke zone is defined as a region of the swash plate which advances the piston from the bottom dead center side toward the top dead center side as the swash plate rotates to discharge refrigerant gas from the compression chamber. The suction stroke zone is defined as another region of the swash plate which returns the piston from the top dead center side toward the bottom dead center side as the swash plate rotates to suck the refrigerant gas into the compression chamber. As a result, a discharge reaction generated as the refrigerant gas is discharged from the compression chamber is accepted by the rotary support via the contact portions of the restriction bosses in contact with the weight within the discharge stroke zone, as seen in the axial direction of the drive shaft, and the hinge mechanism. Accordingly, the positions of the restriction bosses to be in contact with the weight within the discharge stroke zone as seen in axial direction of the drive shaft substantially define the maximum inclination angle of the swash plate. On the contrary, the positions of the restriction bosses in contact with the weight within the suction stroke zone as seen in the axial direction of the drive shaft do not substantially relate to the definition of the maximum inclination angle of the swash plate. In other words, it is useless to provide the restriction bosses within the suction stroke zone as seen in the axial direction of the drive shaft.

SUMMARY OF THE INVENTION

An object of the present invention is to provide a capacity control structure capable of invariably maintaining the maximum inclination angle of a swash plate while avoiding a useless arrangement.

Accordingly, the present invention provides, in a variable displacement compressor comprising a swash plate, accommodated in a control pressure chamber, rotatable together with a rotary shaft while changing the inclination angle relative to the rotary shaft, and a plurality of pistons arranged around the rotary shaft to be subjected to reciprocation in accordance with the inclination angle of the swash plate, wherein the inner pressure of the control pressure chamber is controlled to change the inclination angle of the swash plate, a structure for controlling a capacity comprising a maximum inclination angle-restriction body rotatable together with the rotary shaft, for defining the maximum inclination angle of the swash plate, and a wear-resistant piece attached to at least one of the swash plate and the maximum inclination angle-restriction body, wherein the maximum inclination angle of the swash plate is restricted by the maximum inclination angle-restriction body via the wear-resistant piece, and a mating member is arranged to be in contact with the wear-resistant piece when the swash plate is in a maximum inclination-angle position, and the mating member and the wear-resistant piece are made of wear-resistant material, and wherein the wear-resistant piece is attached to a position contained in a discharge stroke region on the swash plate around the rotary shaft as seen in the axial direction of the rotary shaft.

The wear-resistant piece is solely in the discharge stroke region as seen in the axial direction of the rotary shaft, and the maximum inclination angle of the swash plate is defined solely by the contact of the wear-resistant piece present in the discharge stroke region on the swash plate around the rotary shaft, as seen in the axial direction of the rotary shaft, with the mating member in contact therewith.

The present invention may be more fully understood from the description of the preferred embodiments of the invention set forth below, together with the accompanying drawings.

DESCRIPTION OF THE PREFERRED EMBODIMENTS

Figure 1:
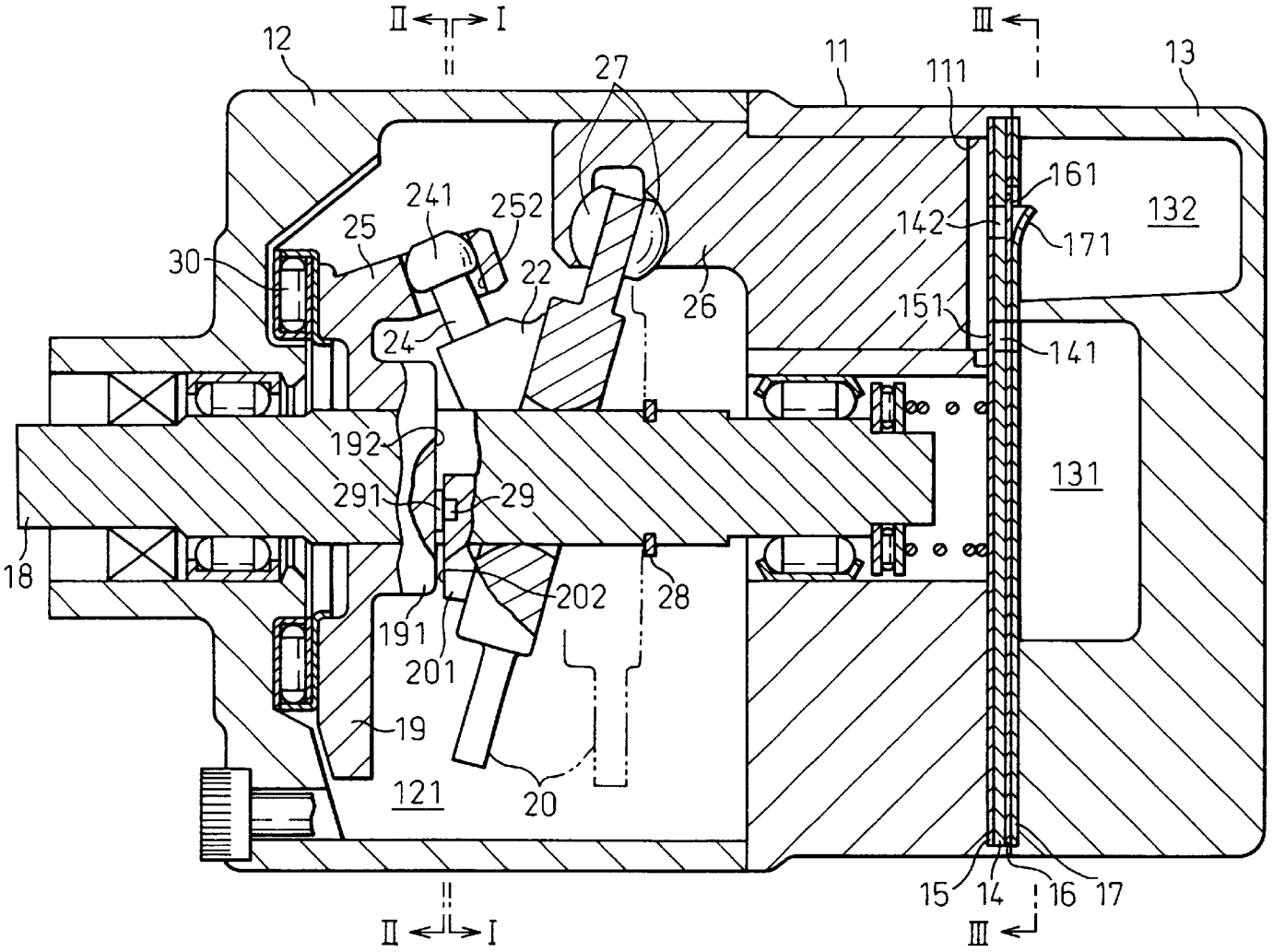
FIG. 1 is a side sectional view of an overall structure of a compressor according to a first aspect of the present invention.

As shown in FIG. 1, a front housing 12 is attached to a front end of a cylinder block 11. A rear housing 13 is fixedly attached to a rear end of the cylinder block 11 via a valve plate 14, valve-forming plates 15, 16 and a retainer-forming plate 17. A rotary shaft 18 is supported for rotation in the front housing 12 and the cylinder block 11 forming a control pressure chamber 121. The rotary shaft 18 extending outward from the control pressure chamber 121 is driven by driving power supplied from an external drive source (not shown) such as a vehicle engine via a pulley and a belt (both not shown).

Figure 2:
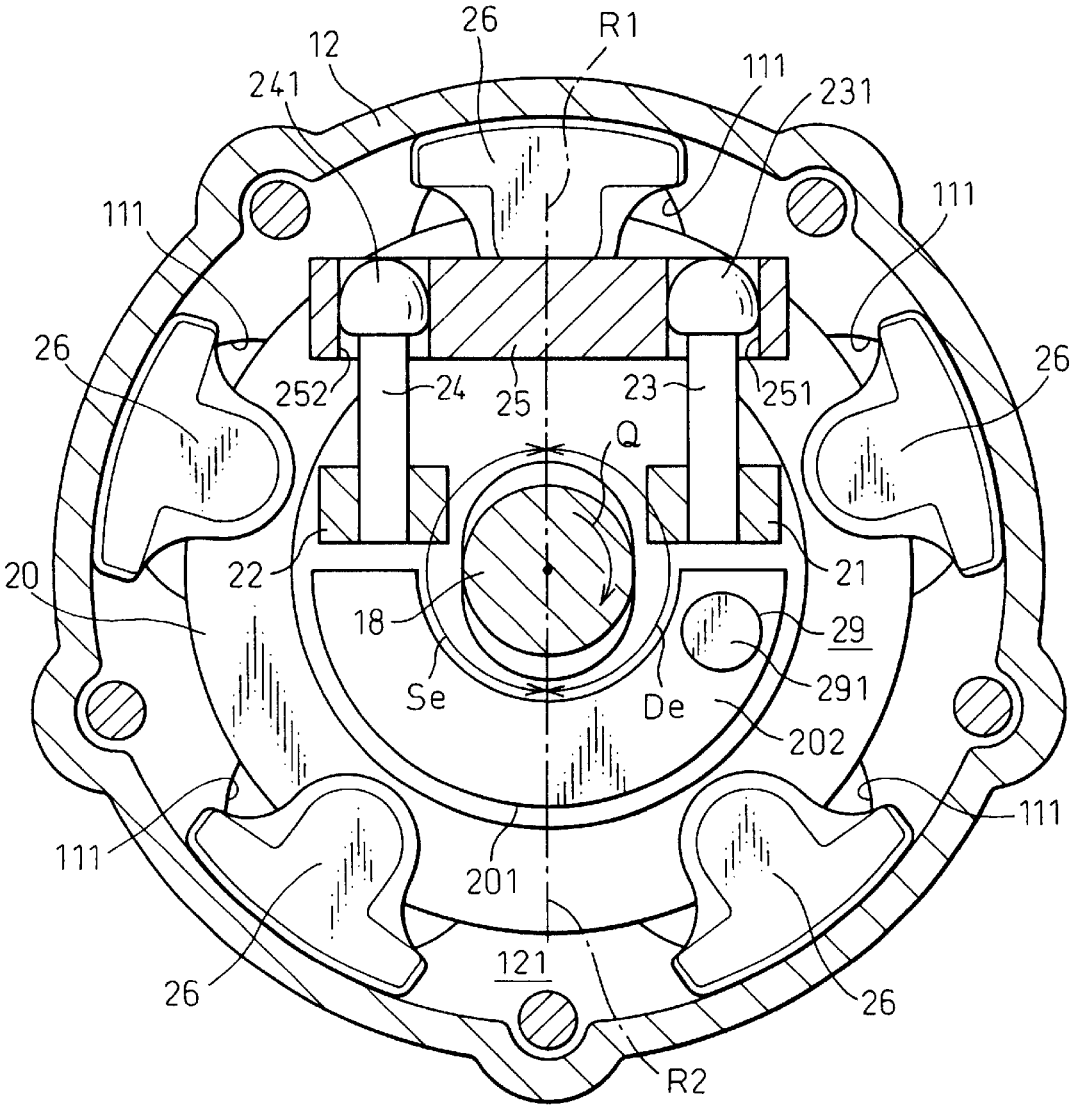
FIG. 2 is a cross-sectional view taken along a plane I—I in FIG. 1.
Figure 3:
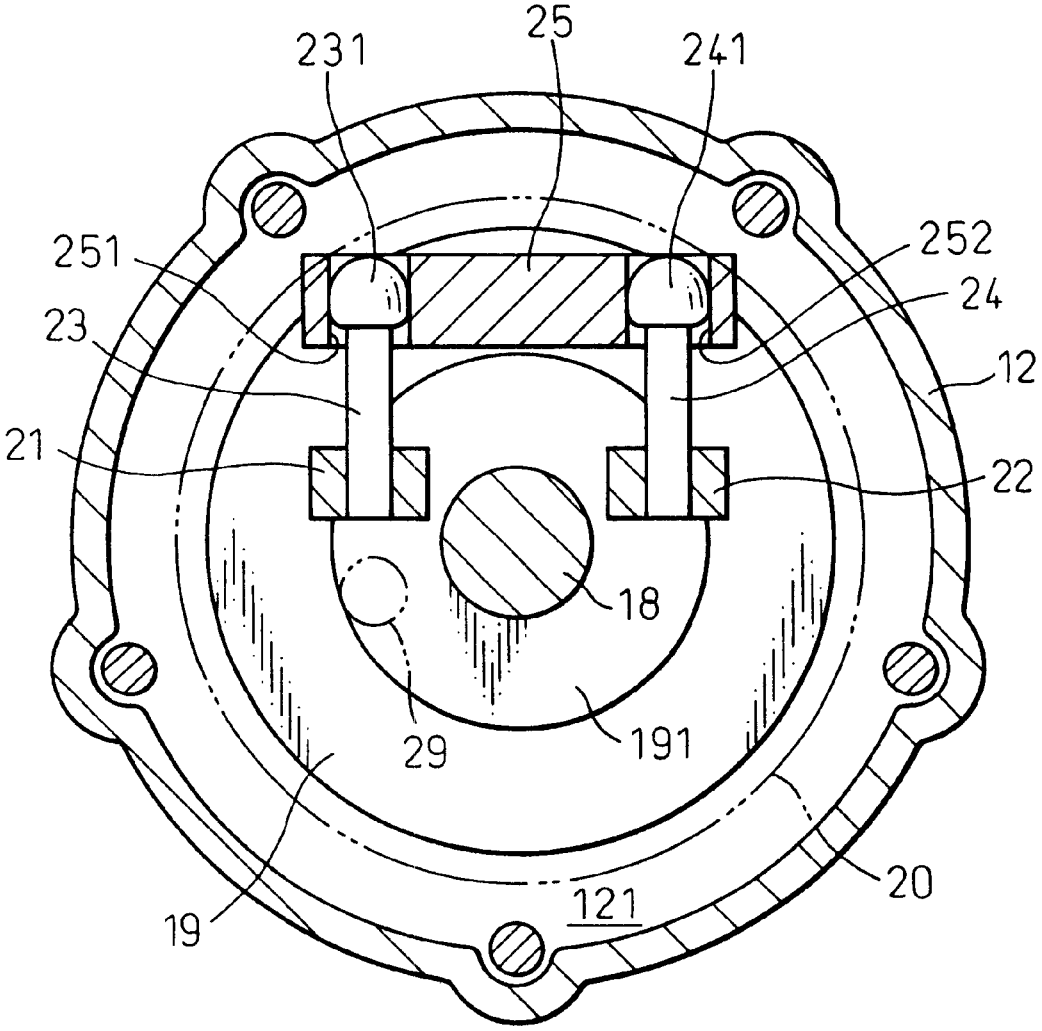
FIG. 3 is a cross-sectional view taken along a plane II—II in FIG. 1.

A rotary support 19 made of iron metal is secured to the rotary shaft 18. Also, a swash plate 20 made of silicon-containing aluminum metal is supported on the rotary shaft 18 to be slidable and tiltable in the axial direction. As shown in FIG. 3, a pair of connecting pieces 21, 22 are fixedly secured to the swash plate 20, and guide pins 23, 24 made of iron metal are fixedly secured to the connecting pieces 21, 22, respectively. A supporting arm 25 is provided on the rotary support 19, and a pair of guide holes 251, 252 are formed in the supporting arm 25. As shown in FIG. 2, the guide holes 251, 252 are parallel to each other as seen in the axial direction of the rotary shaft 18. Also, the guide holes 251, 252 are arranged to be parallel to one of radial lines R1 of the rotary shaft 18 and symmetrical to each other with respect thereto as seen in the axial direction of the rotary shaft 18. The guide pins 23, 24 have spherical heads 231, 241, respectively, which are slidably engaged into the guide holes 251, 252, respectively. The swash plate 20 is tiltable in the axial direction of the rotary shaft 18 and rotatable together with the rotary shaft 18 by the association of the guide holes 251, 252 with the pair of heads 231, 241. The inclination of the swash plate 20 is caused by the slidable guiding action between the guide holes 251, 252 and the guide pins 23, 24 and the slidable supporting action of the rotary shaft 18. The guide pins 23, 24 and the guide holes 251, 252 constitute a hinge mechanism for tilting the swash plate.

If a radial center of the swash plate 20 moves closer to the rotary support 19, the inclination angle of the swash plate 20 becomes larger. Contrarily, if the radial center of the swash plate 20 moves closer to the cylinder block 11, the inclination angle of the swash plate 20 becomes smaller. The minimum inclination angle of the swash plate 20 is defined by the contact of a circlip 28 attached to the rotary shaft 18 with the swash plate 20. The swash plate 20 indicated by a phantom line in FIG. 1 shows a position of the minimum inclination angle of the swash plate 20.

Figure 4:
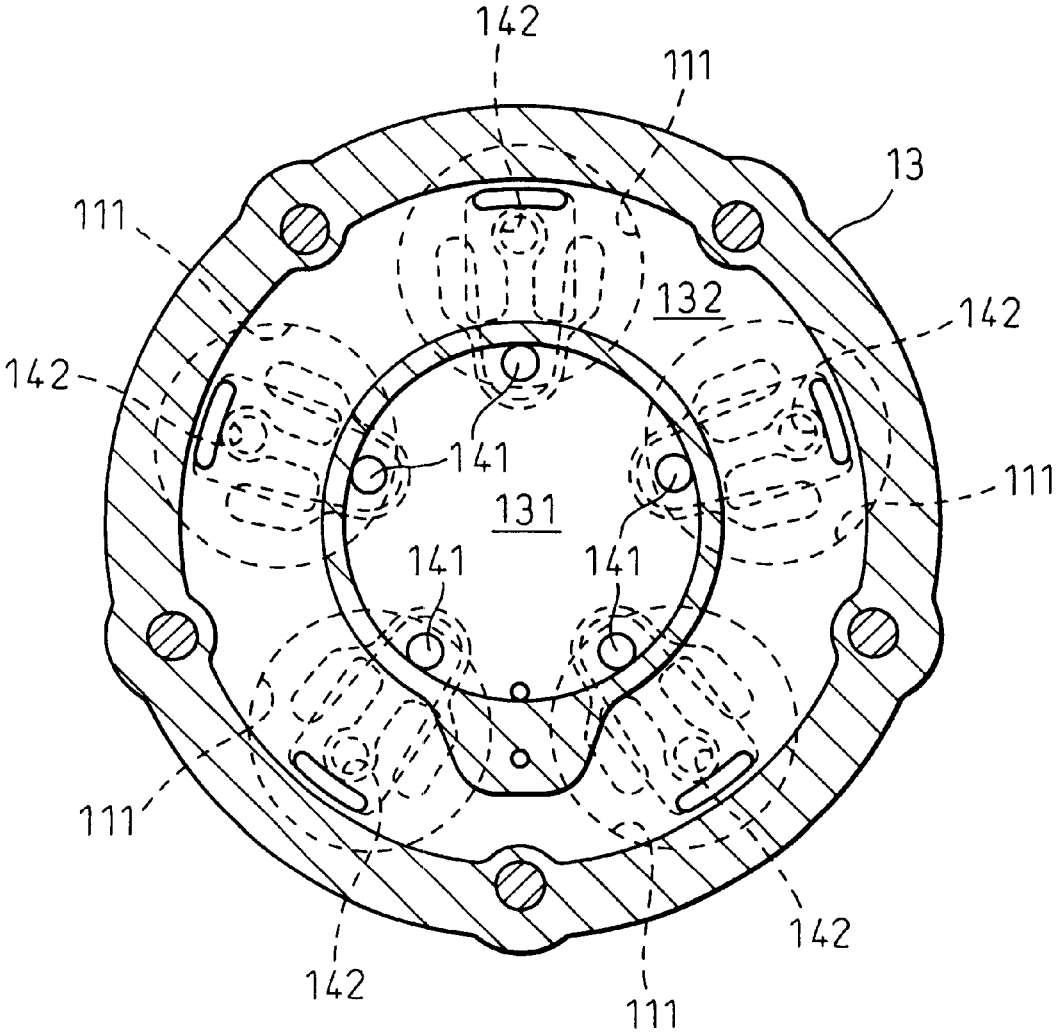
FIG. 4 is a cross-sectional view taken along a plane III—III in FIG. 1.

As shown in FIGS. 2 and 4, a plurality of cylinder bores 111 (five in this aspect) are provided in the cylinder block 11. The plurality of cylinder bores 111 are equi-distantly arranged around the rotary shaft 18 and accommodate pistons 26, respectively, therein. The rotational motion of the swash plate 20 is converted to the reciprocation of the pistons 26 via shoes 27, whereby the respective piston 26 moves forward and rearward within the respective cylinder bore 111.

As shown in FIGS. 1 and 4, a suction chamber 131 and a discharge chamber 132 are arranged in the interior of the rear housing 13. Suction ports 141 are formed in the valve plate 14 and the valve-forming plate 16, while discharge ports 142 are formed in the valve plate 14 and the valve-forming plate 15. A suction valve 151 is formed in the valve-forming plate 15, while a discharge valve 161 is formed in the valve-forming plate 16. Refrigerant gas in the suction chamber 131 flows into the cylinder bore 111 through the suction port 141 by pushing the suction valve 151 during the suction stroke of the piston 26. The refrigerant gas flowing into the cylinder bore 111 is discharged into the discharge chamber 132 through the discharge port 142 by pushing the discharge valve 161 during the discharge stroke of the piston 26. An opening degree of the discharge valve 161 is restricted by the contact thereof with a retainer 171 on the retainer-forming plate 17. The refrigerant discharged into the discharge chamber 132 returns to the suction chamber 131 through an external refrigerant circuit (not shown) provided outside the compressor.

The inner pressure of the control pressure chamber 121 is controlled by a capacity control valve, not shown. The capacity control valve has a function for adjusting a flow rate of the refrigerant supplied from the discharge chamber 132 to the control pressure chamber 121 to regulate the inner pressure of the control pressure chamber 121. The refrigerant in the control pressure chamber 121 leaks into the suction chamber 131 via an extraction passage not shown. As the inner pressure of the control pressure chamber 121 increases, the inclination angle of the swash plate 20 becomes smaller. On the contrary, as the inner pressure of the control pressure chamber 121 decreases, the inclination angle of the swash plate 20 becomes larger.

An annular boss 191 for restricting the inclination angle is formed integrally with the rotary support 19 on a surface thereof opposite to the swash plate 20. A weight 201 is formed in integral with the swash plate 20 on a surface thereof opposite to the rotary support 19. The weight 201 has a function for biasing the swash plate 20 due to the centrifugal force generated by the rotation of the swash plate 20 so that the inclination angle thereof decreases. A wear-resistant piece 29 of iron type metal is press-fitted into the weight 201 on an end surface thereof. A tip end surface 291 of the wear-resistant piece 29 is protruded from the end surface of the weight 201.

As shown in FIG. 2, the rotary shaft 18 rotates in the arrowed direction Q. Since the guide holes 251, 252 are parallel to the radial lines R1 of the rotary shaft 18 and symmetrical with each other in relation to the radial line R1 as seen in the axial direction of the rotary shaft 18, the heads 231, 241 of the guide pins 23, 24 are subjected to a parallel motion along the guide holes 251, 252 as seen in the axial direction of the rotary shaft 18. Accordingly, in the case shown in FIG. 2, the two pistons 26 positioned on the right side from the radial lines R1 and R2 move from the bottom dead center to the top dead center to discharge the refrigerant gas from the cylinder bore 111 to the discharge chamber 132 by the rotation of the swash plate 20. In other words, the two pistons 26 positioned on the right side from the radial lines R1, R2 are in the discharge stroke. The other two pistons 26 positioned on the left side from the radial lines R1, R2 move from the top dead center to the bottom dead center to suck the refrigerant gas from the suction chamber 131 into the cylinder bore 111 by the rotation of the swash plate 20. In other words, the two pistons 26 positioned on the left side from the radial lines R1, R2 are in the suction stroke. If the radial center of the cylinder bore 111 is positioned on the radial line R1, the piston 26 in this cylinder bore 111 is positioned at the top dead center, while if the radial center of the cylinder bore 111 is positioned on the radial line R2, the piston 26 in this cylinder bore 111 is positioned at the bottom dead center.

In the present invention, it is assumed that a region on the swash plate 20, defined from the radial line R1 to the radial line R2 in relation to the rotational direction Q of the rotary shaft 18 (De in FIG. 2), is referred to as a discharge stroke region, and a region on the swash plate 20, defined from the radial line R2 to the radial line R1 in relation to the rotational direction Q of the rotary shaft 18 (Se in FIG. 2), is referred to as a suction stroke region. The weight 201 is of a symmetrical shape in relation to the radial line R2 and the wear-resistant piece 29 is positioned in the discharge stroke region De as seen in the axial direction of the rotary shaft 18. The tip end surface 291 of the wear-resistant piece 29 can be in contact with a tip end surface 192 of the inclination angle-restriction boss 191. The tip end surface 291 of the wear-resistant piece 29 is actually in contact with the tip end surface 192 of the inclination angle-restriction boss 191 when the inclination angle of the swash plate 20 becomes maximum. The position of the swash plate 20 indicated by a solid line in FIG. 1 is the maximum inclination-angle position.

A thrust bearing 30 is interposed between the rotary support 19, which defines the maximum inclination angle and the front housing 12. The thrust bearing 30 bears the discharge reaction applied from the cylinder bore 111 to the rotary support 19 via the pistons 26, the shoes 27, the swash plate 20, connecting pieces 21, 22 and the guide pins 23, 24.

According to the above-mentioned first aspect of the present invention, the following effects are obtainable:

(1) When the inclination angle of the swash plate 20 is maximum, the tip end surface 291 of the wear-resistant piece 29 is in contact with the tip end surface 192 of the inclination angle-restriction boss 191. The contact of the wear-resistant piece 29 made of iron metal with the wear-resistant rotary support 19 of iron metal prevents the swash plate 20 of aluminum metal, which are less resistant to wear than the iron metal, from wearing. The pistons 26 in the cylinder bores 111 positioned on the discharge stroke region De side in the discharge stroke, the discharge reaction of which is applied to the rotary support 19 via the wear-resistant piece 29. When the wear-resistant piece 29 is in contact with the inclination angle-restriction boss 191 as the inclination angle of the swash plate 20 increases, the above-mentioned discharge reaction is applied. Since the discharge reaction is directly applied onto the discharge stroke region De side, the arrangement wherein the wear-resistant piece 29 is included in the discharge stroke region De as seen in the axial direction of the rotary shaft 18 is effective for bearing the discharge reaction on the rotary support 19.

(2) Assuming that the wear-resistant piece 29 is positioned on the suction stroke Se side, the moment of the discharge reaction about the wear-resistant piece 29 on the suction stroke region Se side becomes larger to unnecessarily increase a load applied to the engaging portions between the guide pins 23, 24 and the guide holes 251, 252. Such an unnecessary increase of load in the above-mentioned engaging portions prevents the guide pins 23, 24 from moving smoothly relative to the guide holes 251, 252 which may worsen the initiation of movement of the swash plate 20 from the maximum inclination-angle position to the minimum inclination-angle position. Contrary to this, the arrangement wherein the wear-resistant piece 29 is arranged on the discharge stroke region De side lessens the moment of the discharge reaction about the wear-resistant piece 29 to eliminate the above-mentioned problems caused by the arrangement wherein the wear-resistant piece 29 is provided on the suction stroke region Se side.

(3) There are two engagement positions between the guide pins 23, 24 and the guide holes 251, 252 in the hinge mechanism. Accordingly, if the wear-resistant pieces 29 are provided both in the discharge stroke region De and the suction stroke region Se, the rotary support 19 ought to bear the discharge reaction at two portions on the hinge mechanism side and two portions on the weight 201 side when the swash plate 20 is in the maximum inclination angle. In such a case, however, either one of the two wear-resistant pieces 29 is often actually in contact with the inclination angle-restriction boss 191. If the wear-resistant piece 29 on the discharge stroke region De side is in contact with the inclination angle-restriction boss 191, the other wear-resistant piece 29 on the suction stroke region Se side becomes useless. However, if the wear-resistant piece 29 on the suction stroke region Se side is in contact with the inclination angle-restriction boss 191, the other wear-resistant piece 29 on the discharge stroke region De side becomes useless, and further the problems discussed in the above item (2) may occur. Thus, the arrangement wherein only one wear-resistant piece 29 is provided solely in the discharge stroke region De is optimum for minimizing the wear which is a primary cause of the variation of maximum inclination angle of the swash plate 20, while eliminating the useless elements.

(4) The arrangement wherein aluminum metal is used for forming the swash plate 20 is advantageous in view of the weight reduction of the swash plate 20 which facilitates the smooth operation of varying the inclination angle of the swash plate 20.

(5) It is possible to change the maximum inclination angle of the swash plate 20 by varying a length of the wear-resistant piece 29 projected from the weight 201, whereby various compressor having different maximum inclination angles could be manufactured without altering the shape of the swash plate 20.

(6) The wear-resistant piece 29 is press-fitted into the weight 201. The press-fit is a simple manner of attaching the wear-resistant piece 29.

Figure 5:
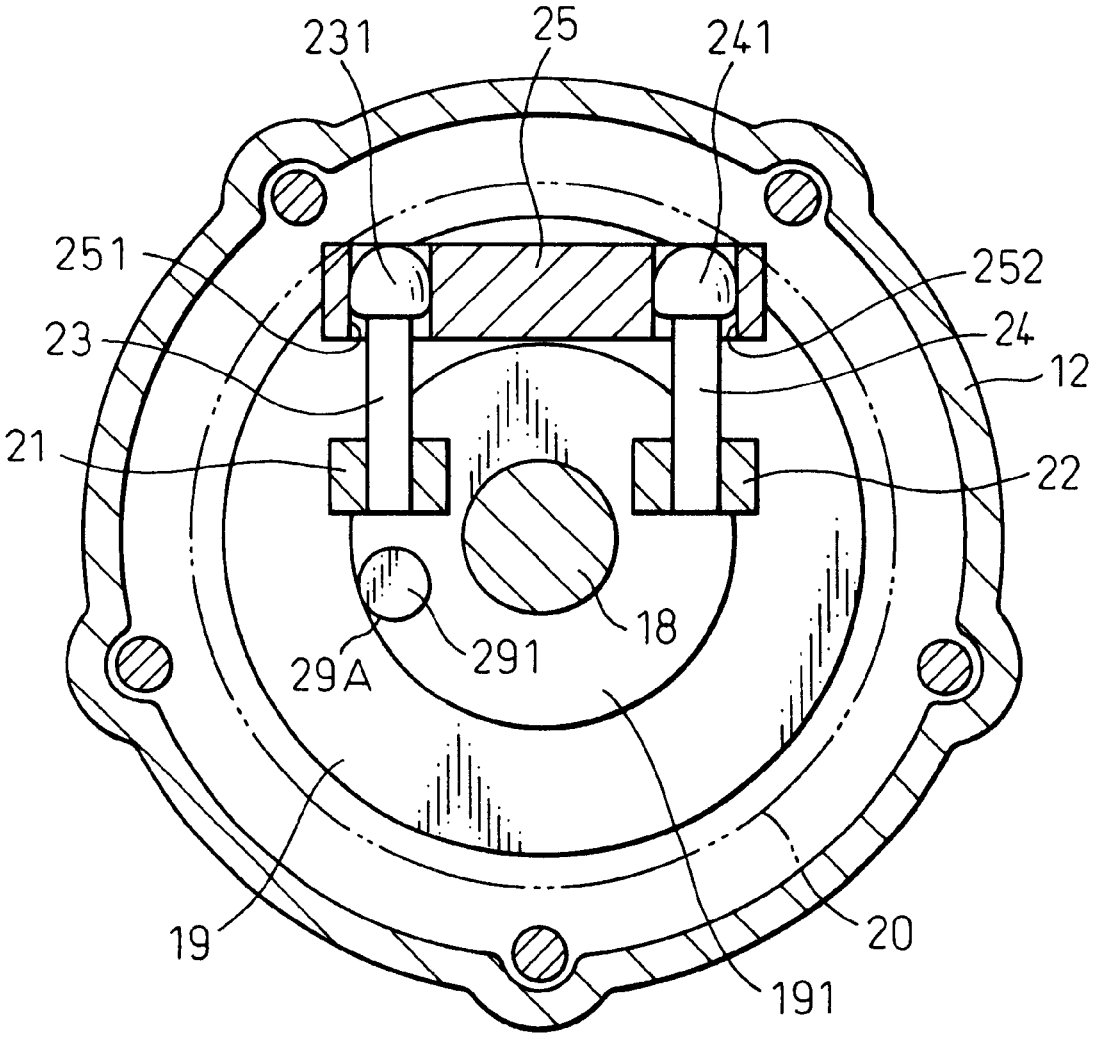
FIG. 5 is a side sectional view of a second aspect of the present invention.

Next, a second aspect of the present invention will be described with reference to FIG. 5 wherein the same reference numerals are used for denoting the same or similar parts as in the first aspect.

According to this aspect, a wear-resistant piece 29A is attached onto the rotary support 19 side. The rotary support 19 is made of aluminum metal, while the swash plate 20 is made of iron metal. The wear-resistant piece 29A is in the discharge stroke region De as seen in the axial direction of the rotary shaft 18. When a tip end surface 291 of the wear-resistant piece 29A is actually in contact with the weight 201, the maximum inclination angle of the swash plate 20 is obtained. In this aspect, the same effects are achievable as discussed in the above-mentioned items (1) to (3) with reference to the first aspect.

Figure 6:
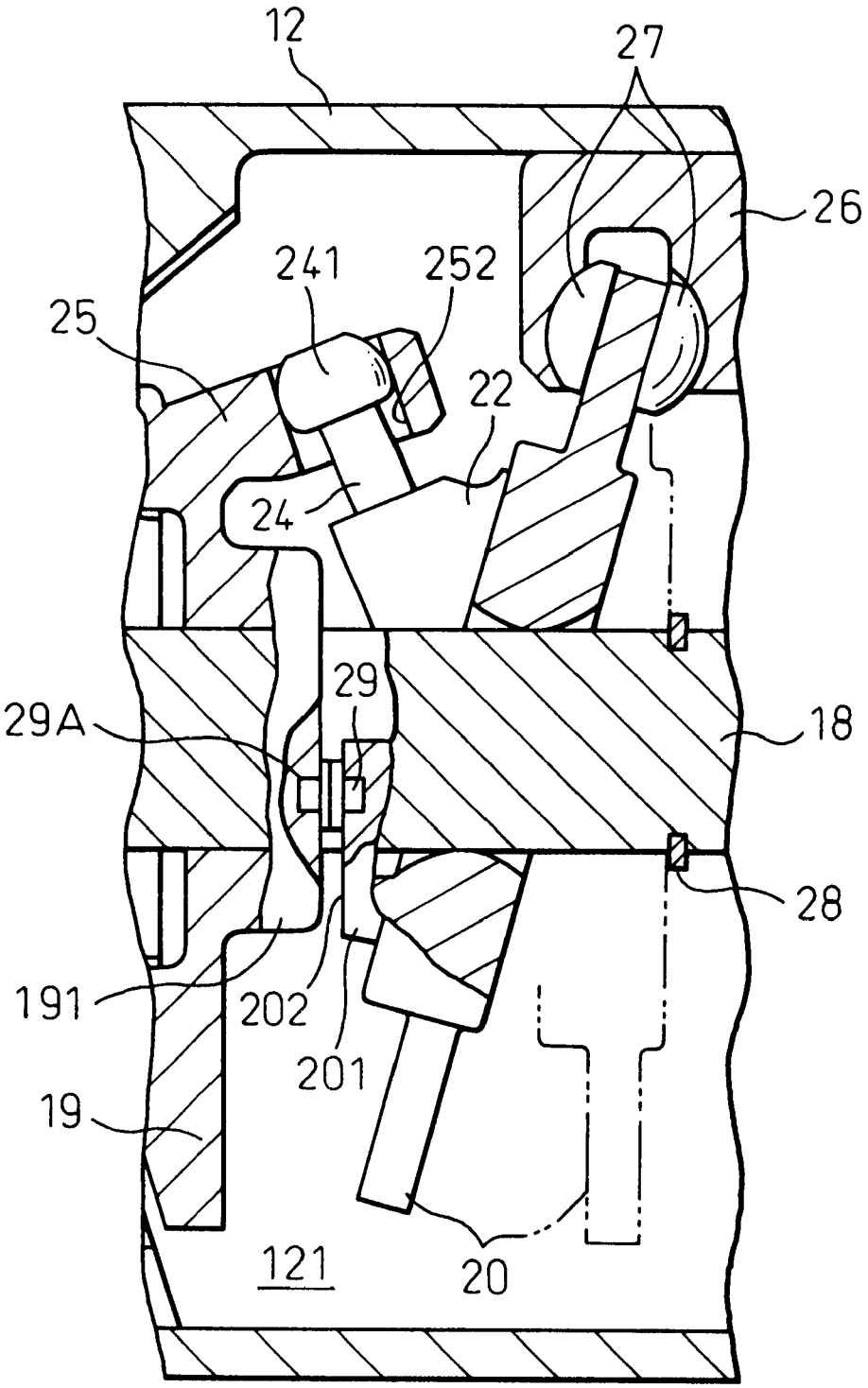
FIG. 6 is a side sectional view of a main part of a third aspect of the present invention.

A third aspect of the present invention will be described with reference to FIG. 6 wherein the same reference numerals are used for denoting the same or similar parts as in the first aspect.

According to this aspect, a wear-resistant piece 29 is attached onto the swash plate 20 side and another wear-resistant piece 29A is attached onto the rotary support 19 side. Both of the rotary support 10 and the swash plate 20 are made of aluminum metal. The wear-resistant pieces 29, 29A are in the discharge stroke region De as seen in the axial direction of the rotary shaft 18. The tip end surfaces 291 of the wear-resistant pieces 29, 29A can be in contact with each other. When the tip end surfaces 291 of the wear-resistant pieces 29, 29A are actually in contact with each other, the maximum inclination angle of the swash plate 20 is obtained. In this aspect, the same effects, as discussed in the above-mentioned items (1) to (4) with reference to the first aspect, are achievable. In addition, since both of the rotary support 19 and the swash plate 20 are made of aluminum metal, the weight of the compressor is reduced to a great extent.

Figure 7:
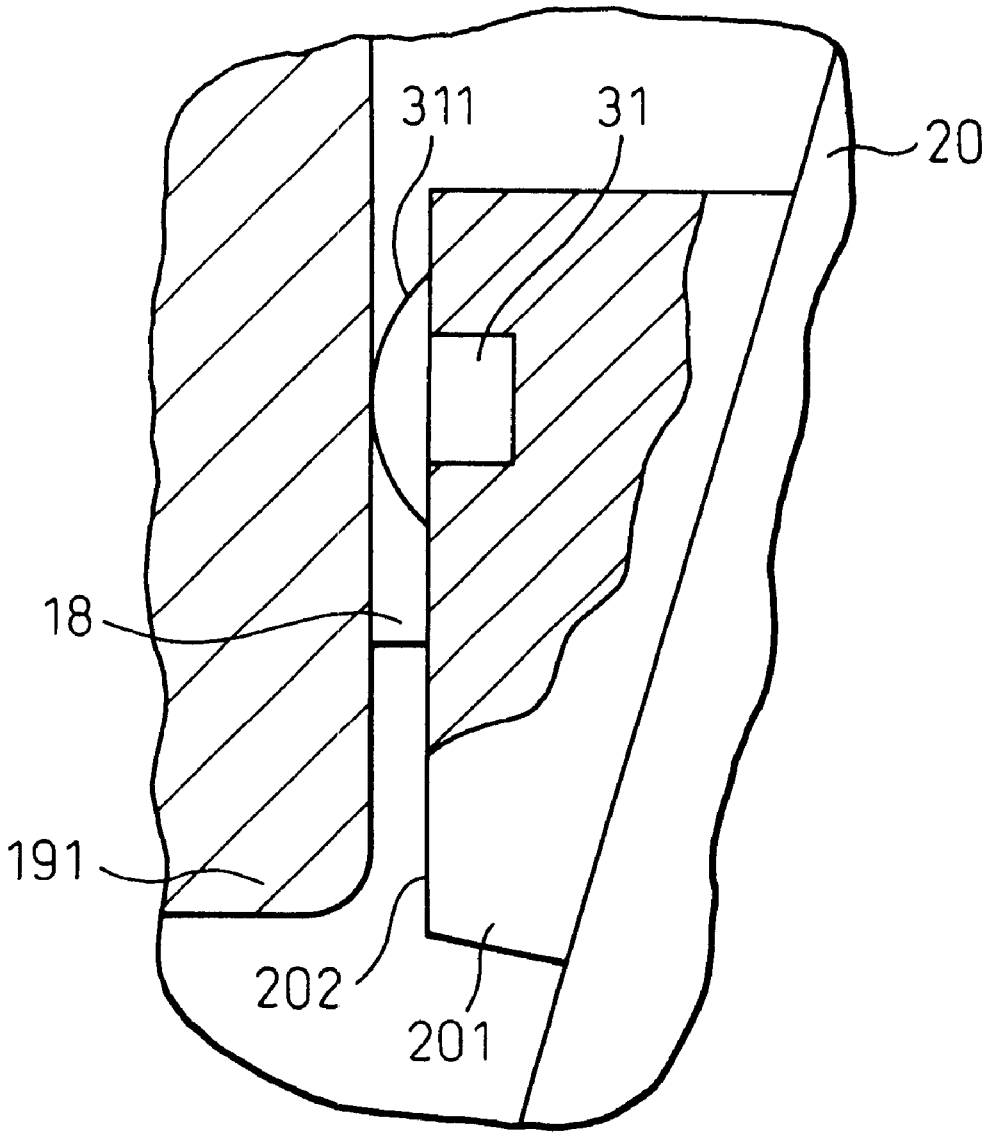
FIG. 7 is a side sectional view of a main part of a fourth aspect of the present invention.

Next, a fourth aspect will be described with reference to FIG. 7 wherein the same reference numerals are used for denoting the same or similar parts as in the first aspect.

A tip end surface 311 of a wear-resistant piece 31 in this aspect is convex, for example, and forms a spherical surface. In the case of the preceding wear-resistant piece 29, it may happen that an edge of the tip end surface 291 of the wear-resistant piece 29 is liable to unsymmetrically abut the rotary support 19 due to shaping tolerances or assembly tolerances. Contrary to this, the tip end surface 311 of a convex curvature is able to be in surface-contact with the rotary support 19 as seen in a localized area. Therefore, the wear of the tip end surface 311 is significantly improved.

Figure 8:
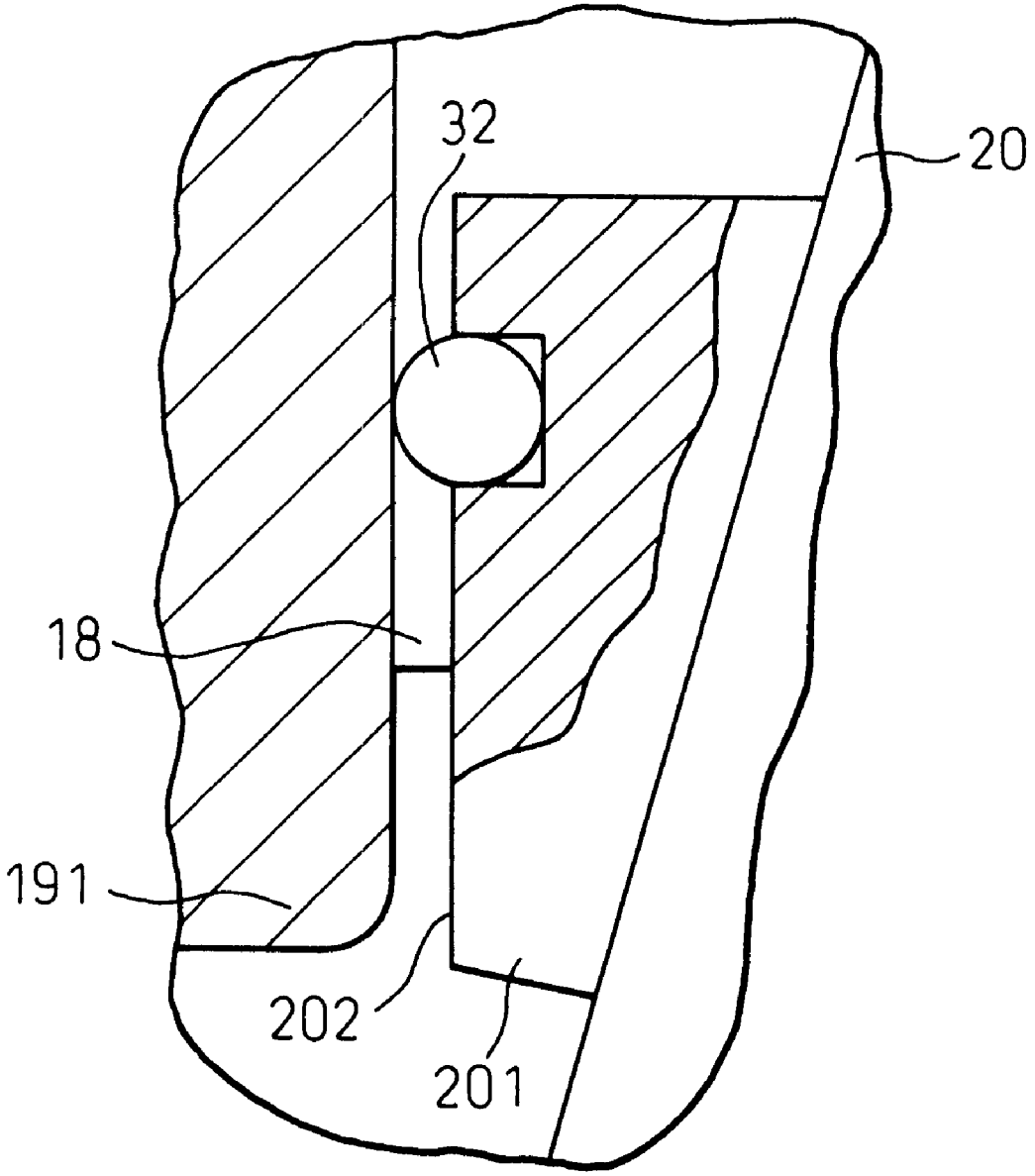
FIG. 8 is a side sectional view of a main part of a fifth aspect of the present invention.

According to a fifth aspect of the present invention shown in FIG. 8, a wear-resistant piece 32 of a steel ball type is press-fitted into the weight 201 of the swash plate 20, resulting in the same effects as in the fourth aspect.

As described in detail above, since a position of the wear-resistant piece is determined to be contained in the discharge stroke region of the swash plate around the rotary shaft as seen in the axial direction of the rotary shaft, it is possible to achieve an excellent effect wherein the maximum inclination angle is constantly maintained while eliminating useless elements.

While the present invention has been described by reference to specific embodiments chosen for the purpose of illustration, it should be apparent that numerous modifications could be made thereto by those skilled in the art without departing from the basic concept and scope of the invention.

What is claimed is:

1. In a variable displacement compressor comprising a swash plate accommodated in a control pressure chamber, to be rotatable together with a rotary shaft while changing the inclination angle relative to the rotary shaft, and a plurality of pistons arranged around the rotary shaft to be subjected to a reciprocation in accordance with the inclination angle of the swash plate, wherein the inner pressure of the control pressure chamber is controlled to change the inclination angle of the swash plate, a structure for controlling a capacity in the variable displacement compressor comprising a maximum inclination-angle restriction body rotatable together with the rotary shaft, for defining the maximum inclination angle of the swash plate, and a wear-resistant piece attached to at least one of the swash plate and the maximum inclination angle-restriction body, wherein the maximum inclination angle of the swash plate is restricted by the maximum inclination angle-restriction body via the wear-resistant piece, and a mating member is arranged to be in contact with the wear-resistant piece when the swash plate is in a maximum inclination-angle position, and the mating member and the wear-resistant piece are made of wear-resistant material, and wherein the wear-resistant piece is attached to a position contained in a discharge stroke region on the swash plate around the rotary shaft as seen in the axial direction of the rotary shaft.

2. A structure for controlling a capacity in a variable displacement compressor as defined by claim 1, wherein the maximum inclination angle-restriction body and the swash plate are made of materials having different wear-resistance, respectively, and the wear-resistant piece is attached either one of the maximum inclination angle-restriction body or the swash plate, which has a lower wear-resistance.

3. A structure for controlling a capacity in a variable displacement compressor as defined by claim 2, wherein the swash plate is made of aluminum type metal, the maximum inclination angle-restriction body is of iron type metal, and the wear-resistant piece is of iron type metal.

4. A structure for controlling a capacity in a variable displacement compressor as defined by claim 1, wherein the swash plate and the maximum inclination angle-restriction body are made of aluminum type metal, the wear-resistant piece is of iron type metal and is attached to both of the swash plate and the maximum inclination angle-restriction body.

5. A structure for controlling a capacity in a variable displacement compressor as defined by claim 1, wherein the wear-resistant piece is shaped to have a tip end surface of a convex curvature.

6. A structure for controlling a capacity in a variable displacement compressor as defined by claim 1, wherein the wear-resistant piece is attached by press-fitting.

* * * * *